United States Patent [19]

Burke

[11] 4,133,647

[45] Jan. 9, 1979

[54] METHOD FOR PELLETIZING CARBONACEOUS SOLIDS

[75] Inventor: Francis P. Burke, Bethel Park, Pa.

[73] Assignees: Continental Oil Co., Stamford, Conn.; The United States of America as represented by the United States Department of Energy, Washington, D.C.

[21] Appl. No.: 835,627

[22] Filed: Sep. 22, 1977

[51] Int. Cl.[2] ..... C10L 5/14; C10L 9/00

[52] U.S. Cl. ..... 44/24; 44/6; 209/49

[58] Field of Search ..... 44/6, 24, 10 R; 209/49

[56] References Cited

U.S. PATENT DOCUMENTS

| | | | |
|---|---|---|---|
| 1,512,427 | 10/1924 | Trent | 44/24 |
| 1,895,056 | 1/1933 | Trent | 44/10 R |
| 2,843,462 | 7/1958 | Brown | 44/24 |
| 3,045,818 | 7/1962 | Muschenborn et al. | 209/49 |
| 3,775,070 | 11/1973 | Messer et al. | 44/10 R |

*Primary Examiner*—Carl Dees

*Attorney, Agent, or Firm*—F. Lindsey Scott; William A. Mikesell, Jr.; D. Leigh Fowler, Jr.

[57] ABSTRACT

An improved method for agglomerating finely divided carbonaceous solids is disclosed. The method comprises mixing the solids with oil having a softening point above about 100° C in an aqueous medium at a temperature above about 120° C and at a pressure greater than about 1000 mm Hg.

10 Claims, 2 Drawing Figures

METHOD FOR PELLETIZING CARBONACEOUS SOLIDS

Figure 1:
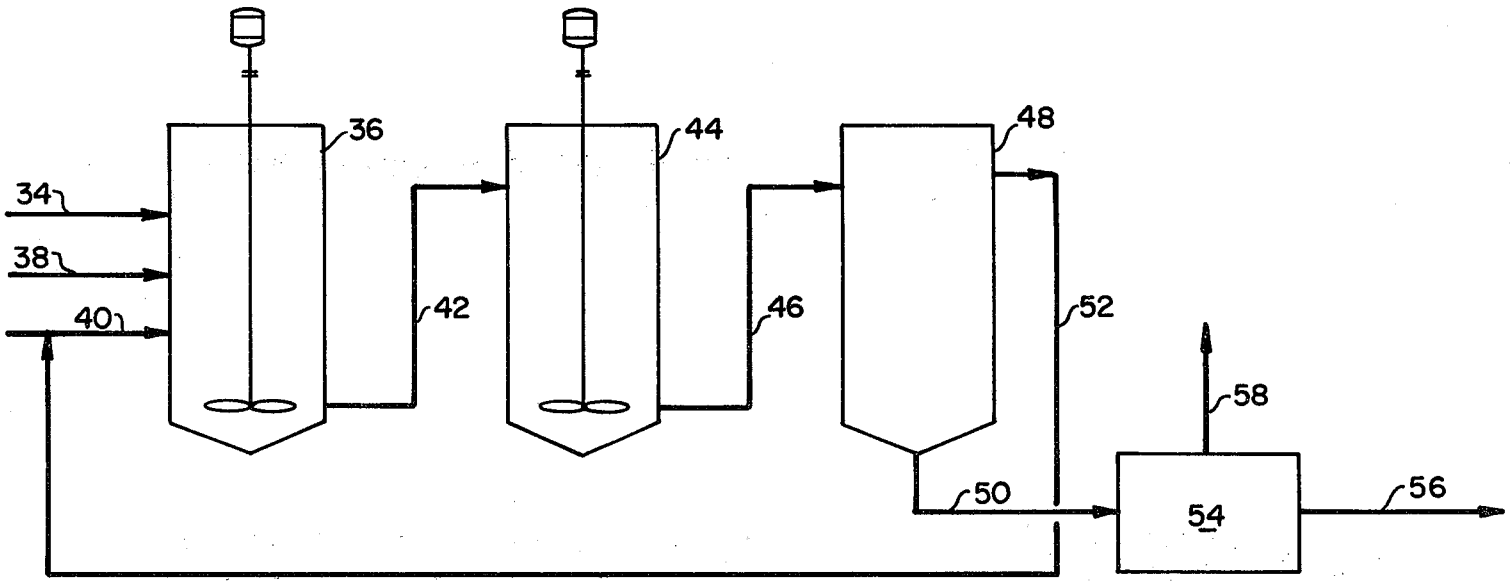

This invention relates to the agglomeration of finely divided carbonaceous solids.

This invention further relates to the oil agglomeration of finely divided carbonaceous solids to produce temperature-resistant, high-crush strength and abrasion-resistant agglomerates.

In many industrial processes, an undesirable by-product is finely divided carbonaceous solids. Such solids are produced as a by-product in processes such as the production of carbon black, the refining of petroleum, the production of petroleum coke, the mining and cleaning of coal and the like. Such solids are produced both in dry form and as aqueous dispersions of the carbonaceous solids, either as such or in mixture with contaminants such as clays, gangues, and the like. In many instances, it is desirable to recover these finely divided carbonaceous solids as larger agglomerated particles suitable for use as a feedstock for gasifiers, coal-fired furnaces or the like. As agglomerated, the carbonaceous solids are suitable as a fuel and the handling difficulties associated with finely divided materials are avoided to a large extent.

The agglomeration of finely divided carbonaceous solids by mixing aqueous dispersions of such carbonaceous solids with oil has been known for many years. One such process is shown in U.S. Pat. No. 1,512,427 issued Oct. 21, 1924 to Trent. Such processes have in the main operated at or about room temperature, although, in some instances, temperatures up to about 100° C. have been used. The oils used are normally those oils which are liquid and suitable as binders at the temperature used. The use of such oils results in the formation of agglomerates which are not resistant to high temperatures in the event they are fed to processes wherein they are subjected to high temperature prior to entering the combustion zone or wherein it is necessary that they remain agglomerated in the presence of relatively high temperatures. U.S. Pat. No. 1,512,427 attempts to remove a portion of the light oil introduced into the agglomerates by the use of mixtures of oil.

Even though the processes used heretofore have been successful in forming agglomerates from finely divided carbonaceous solids suspended in an aqueous medium, the resulting agglomerates have not heretofore been produced using oils in the agglomeration zone which have melting points substantially above 100° C. to produce stronger agglomerates which are temperature-resistant beyond 100° C. Since the use of the agglomerates as feedstock to gasifiers such as Lurgi gasifiers and the like requires that the agglomerates retain their structural integrity for a substantial period of time at elevated temperatures, a continuing search has been directed to the development of methods whereby strong, attrition-resistant and temperature-resistant agglomerates can be produced.

It has now been found that such agglomerates are produced by an improvement in methods for agglomerating finely divided carbonaceous solids by mixing the solids with oil in an aqueous medium, the improvement comprising; mixing the solids with oil having a softening point above about 100° C. at a temperature above about 120° C. at a pressure greater than about 1000 mm Hg.

Figure 2:
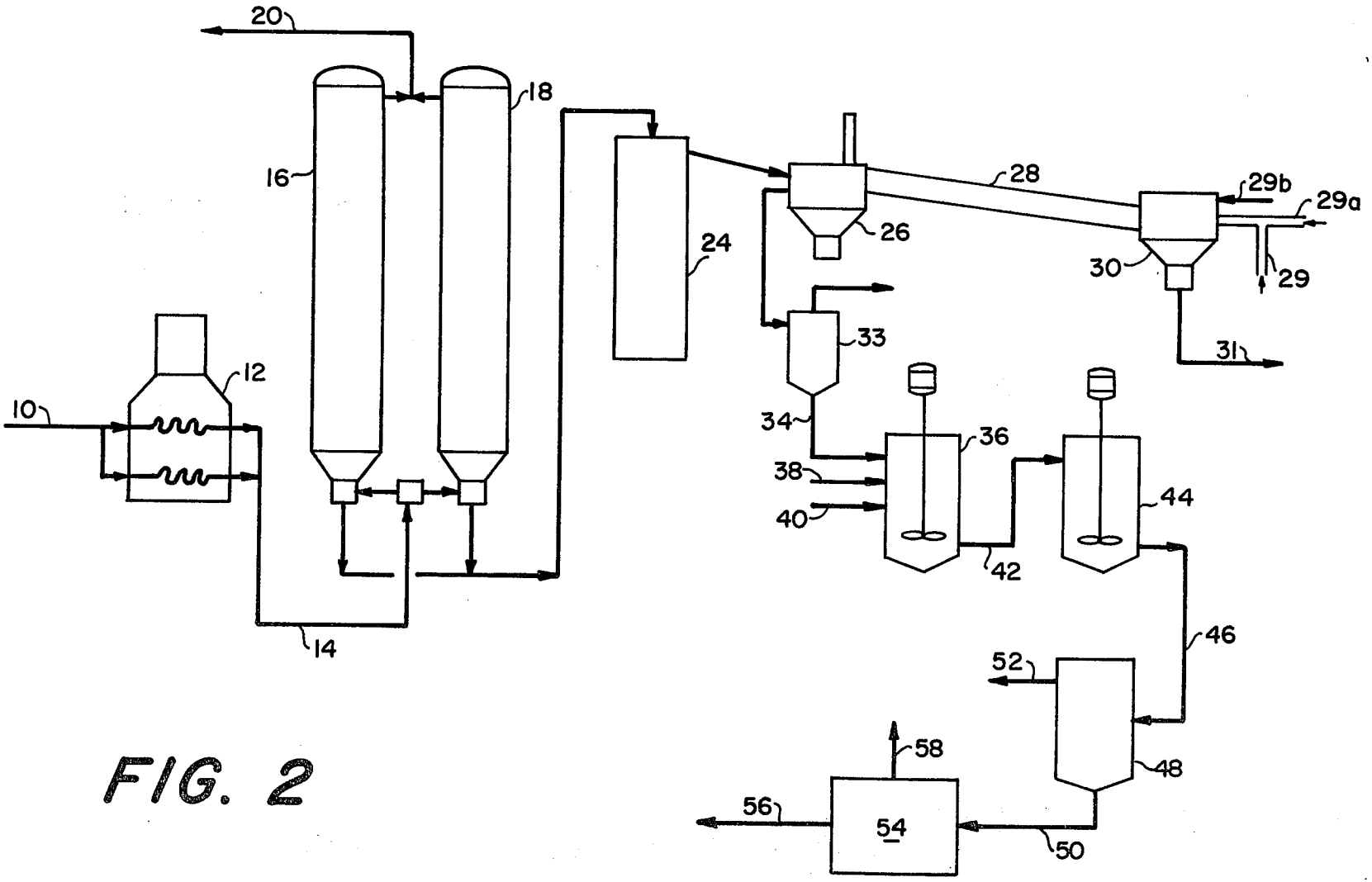

FIG. 1 is a schematic diagram of a process embodying the improvement of the present invention; and FIG. 2 is a schematic diagram of a petroleum coke process embodying the improvement of the present invention.

In the discussion of the figures, the same terminology will be used to refer to the same elements throughout.

In FIG. 1, an agitated first vessel 36 is shown. Finely divided solids, binder (oil) and water are introduced into vessel 36 through lines 34, 38 and 40 respectively. Clearly, any two or all three of these streams could be optionally added through a single line. The water, oil or both, may optionally be heated prior to charging to vessel 36. The agitation in vessel 36 is effective in mixing the binder, solids and water so that the solids become coated with the oil. Relatively high mixing rates are used. Mixing power inputs from about 0.3 to about 2.0 hp/ft$^3$ are commonly used with values from about 0.4 to about 0.7 hp/ft$^3$ being more common. The optimum agitation is variable depending upon the particular solids subjected to agglomeration, the types of oil used, and the like. Normally, inversion, i.e. the coating of the solids with oil, is complete when the presence of oil is no longer observed in the inverter, although such a general rule of thumb is clearly subject to qualification when excessive amounts of oil are used, or the like. Normally, a color change occurs when the particles become coated with the oil, such that the bulk of the oil is removed from the aqueous suspension. The term "inversion" is normally used in the art to refer to the coating of the oil onto the carbonaceous solids. The carbonaceous solids coated with oil begin to agglomerate to some extent in vessel 36, although in most instances agglomeration is not complete when the solids-containing stream removed from vessel 36 is passed through line 42 to a second agitated vessel 44. In vessel 44, lower rates of agitation are used with values from about 0.3 to about 0.4 hp/ft$^3$ being typical. The lower rate of agitation in vessel 44 tends to result in the agglomerates growing in size with agglomerates up to $\frac{1}{8}$ inch or larger being commonly produced. A solids-containing stream is removed from vessel 44 through a line 46 and passed to a vessel 48 where settling is accomplished with a solids stream being removed from the bottom of vessel 48 through a line 50 and passed to a flash evaporator 54 wherein the water remaining with the solids is flashed to steam recovery or the like with the solid product being recovered through line 56. Water is recovered from vessel 48 though a line 52 and optionally recycled to water inlet 40 to vessel 36.

The process is operated at a pressure greater than about 1000 mm Hg at a temperature greater than about 120° C. so that oils having a softening point above about 100° C. can be used. Desirably, the oil has a softening point from about 100 to about 330° C. and the temperature is from about 120 to about 130° C. with the pressure being from about 1000 to about 125,000 mm Hg.

In the practice of the present invention, oils which are not usable in oil agglomeration processes as known to the art, are useful and result in the production of harder, more attrition-resistant agglomerates which are resistant to high temperatures. For instance, oils having a softening point equal to or greater than the temperature to which the agglomerates are to be exposed prior to combustion can be used in the agglomeration process, thereby producing agglomerates which retain their structural integrity as agglomerates during charging, handling and the like. As a further advantage of the present process, the drying of the agglomerates is greatly simplified. Since the process operates at elevated temperature and pressure, the agglomerates are readily recovered by means known to those skilled in the art such as centrifuging, screening, decantation or the like to produce a mixture of agglomerates which contains relatively minor portions of water. The agglomerates are then passed to a zone where the pressure is rapidly reduced with the water vapor flashing off as the pressure is lowered. The rate at which the pressure is lowered can be varied if necessary to prevent structural damage to the agglomerates which might result if the pressure was lowered too rapidly. Such a procedure results in the production of a dried agglomerate which is stronger, more attrition-resistant and more temperature-resistant than those produced previously by processes known to the art.

In a preferred embodiment of the present invention, fines produced in the production of petroleum coke are treated by the process of the present invention. Processes for the production of petroleum coke are known to the art as shown, for instance, in U.S. Pat. No. 3,257,309 issued June 21, 1966 to Fauchier et al. In FIG. 2, such a process is shown. A heavy, petroleum residuum prepared by appropriate fractionation of crude oil is passed from a fractionation tower (not shown) via a line 10 to a suitable preheater 12. From preheater 12, the residuum is charged through line 14 to one or the other of delayed coking drums 16 and 18. The temperature of the residuum charged to the coke drums is typically from about 850° F. to about 950° F. A stream of vapor is normally recycled to the fractionator from the top of the coke drums at a temperature of about 830° F. and about 30 p.s.i.g. by way of a conduit 20.

The pressure in coking drums 16 and 18 is maintained at from about 20 to about 80 p.s.i. and the drums are well insulated to minimize heat loss so that the reaction temperature lies between about 830° F. and about 900° F. The hot charge stock in coking drums 16 and 18 decomposes over a period of several hours liberating hydrocarbon vapors which continuously rise through the mass of material contained in the drums. The first stages of thermal decomposition occurring in the charge stock within the coking drums reduce the heavy petroleum residuum to a very heavy tar or pitch which subsequently undergoes further decomposition into solid coke. The ascending hydrocarbon vapors in the coking drums produce pores and channels in the coke through which the incoming oil from the furnace may pass. This process is continued until the drum in use is filled with a mass of solid coke. The vapors which are evolved in the course of the decomposition occurring within the coking drums are vented from the top of the drums and returned to a suitable fractionating tower (not shown) where they are fractionated into desired cuts.

After one of coking drums 16 or 18 has become filled with solid coke, the coke is cooled and is then removed from the drum by means of high impact-producing water jets (not shown) which are directed from nozzles incorporated in special boring and cutting tools (not shown). The lumps of coke which are broken free from the walls of the coke drum by the high impact water jets fall from the drum and are mechanically transferred to a drainage and storage apron (not shown). Water drains from the coke to a collecting pit which contains a considerable amount of coke fines.

The coke is then fed into a silo 24 from which it is fed into a housing 26 and from thence into an inclined rotary kiln 28. The coke which is discharged from silo 24 will contain a substantial portion of undersized coke fines with their distribution in the feed from silo 24 to housing 26 being determined by the evenness with which they have been distributed in the coke bed contained in the silo during storage.

Coke passes downwardly from housing 26 through kiln 28 where it is calcined at a temperature of about 2500° F. by contact with hot gases passing upwardly through the kiln and counter-currently to the flow of the coke. The hot gases in the calcining kiln 28 are created partially by the combustion of fuel gas introduced at 29. Primary and secondary sources of air are supplied through lines **29*a* and 29*b* affording an excess of air over that required to combust the fuel gas introduced at 29. The hot gases are also created by combustion of the volatile hydrocarbons from the raw coke with the excess air although the combustion of such hydrocarbons can be reduced by fluidizing a portion of the fines from cyclone separator 33 and burning such fluidized fines in kiln 28 by introducing them into the firing hood along with the secondary source of air 29*b*. Although some of the fines which enter the calcining kiln 28 with the larger particles of coke are consumed within the kiln, a substantial portion of the fines is not burned and calcined in the kiln along with the larger particles. The calcined coke with a certain amount of calcined fine material is collected in a firing hood 30 at the lower end of kiln 28 and from the firing hood is conveyed via a line 31** to storage.

As an alternative to discharging the combustion gases from kiln 28 to the atmosphere by suitable venting of housing 26, it has heretofore been proposed that the hot gases and entrained fines be passed from the upper end of kiln 28 and housing 26 into a cyclone separator 33 where the fines are removed from the hot gases. The fines are then passed through a line 34 to a first agitator vessel 36 and mixed with oil and water introdueced through lines 38 and 40 respectively. The operation of vessel 36 is as described with respect to FIG. 1 with a solids-containing stream being removed from the lower portion of vessel 36 through line 42 and passed to a second agitation vessel 44 which is operated as described in the description of FIG. 1 above. A solids-containing stream is removed from the lower portion of vessel 44 through a line 46 and passed to a settling vessel 48 where agglomerates and solids are removed through a line 50 and water is removed through a line 52. The solids are then passed to a flash evaporator 54 where the water is removed through a line 58 and the solid product is recovered through a line 56.

The fines-containing drain water recovered in the removal of the coke from the delayed coking drums is also a suitable charge stock for treatment by the process of the present invention as are the coke fines in the collecting pit.

The primary requisite in the oil used in the present invention is that it be liquid at the temperature and pressure used. Clearly, the oils of interest have softening points above 100° C. and below about 330° C. Typically, the oil will have a softening point of from about 150° C. to about 250° C. The oils can be selected from petroleum stocks, coal tars, pitches, and the like. Further, the oil may contain entrained solids. The quantity of the entrained solids is not critical so long as the fluidity and softening point of the oil are not moved outside the desired ranges for use in agglomerating the carbonaceous particles introduced into the mixing zone. One such oil is the underflow stream from deashing operations wherein coal extracts are treated to remove unconverted coal, ash and the like. Such underflow streams are clearly suitable as the oil in the present invention. Coal extract streams are also suitable, as are heavy petroleum residuum used in the production of petroleum coke. When petroleum coke feedstock is used as the oil, it is possible to use the agglomerates as a feedstream to the delayed coker drums.

One desirable end use of the agglomerates produced by the present invention is as feedstock to a Lurgi gasifier wherein it is desirable that the particles fed to the gasifier retain their particulate integrity at high temperatures. Clearly when oils having softening points above a given temperature are used, it is to be expected that the agglomerates will have a softening points equal to at least that of the oil used, i.e. when an oil having a softening point of 250° C. is used, the agglomerates will retain their structural integrity up to at least 250° C.

Typically, the solids charged to the agglomeration zones have a size less than about 48 mesh, although considerable variation in the size of the finely divided carbonaceous solids is possible. Clearly, when the solids charged are larger than the desired size in the product agglomerates, there is no reason to go through the oil agglomeration step. In other words, any particle smaller than the desired size can be charged to the agglomeration process for agglomeration to produce particles of a larger size.

Having thus described the invention by reference to certain of its preferred embodiments, it is pointed out that the embodiments described while preferred are illustrative rather than limiting in nature and that many variations and modifications are possible within the scope of the present invention. It is anticipated that many such variations and modifications may be considered obvious or desirable to those skilled in the art upon a review of the foregoing description of preferred embodiments.

Having thus described the invention, I claim:

1. In a method for agglomerating finely divided carbonaceous solids by mixing said solids with a binder in an aqueous medium the improvement comprising mixing said solids with said binder at a temperature above about 120° C. at a pressure greater than about 1000 mm Hg, said binder consisting essentially of an oil having a softening point above about 100° C.

2. The improvement of claim 1 wherein said oil has a softening point from about 100 to about 330° C. and wherein said temperature is from about 120 to about 350° C. and said pressure is from about 1000 to about 125,000 mm Hg.

3. The improvement of claim 2 wherein said oil has a softening point from about 150 to about 250° C.

4. The improvement of claim 1 wherein said oil is present in an amount equal to from about 10 to about 40 weight percent based on the weight of said solids.

5. The improvement of claim 4 wherein said oil is present in an amount equal to from about 20 to about 30 weight percent.

6. The improvement of claim 1 wherein said solids are of a size less than 48 mesh.

7. The improvement of claim 1 wherein said solids are petroleum coke fines.

8. The improvement of claim 7 wherein said oil is a coking stock suitable as a charge to a coking feed drum.

9. The improvement of claim 1 wherein oil is derived from coal.

10. The improvement of claim 9 wherein said oil contains finely divided solids.

* * * * *

UNITED STATES PATENT OFFICE
CERTIFICATE OF CORRECTION

PATENT NO. : 4,133,647

DATED : January 9, 1979

INVENTOR(S) : Francis P. Burke

It is certified that error appears in the above-identified patent and that said Letters Patent are hereby corrected as shown below:

[73] Assignee: is incorrect. This should be corrected to read "Continental Oil Company, Stamford, Conn." The remaining portion of this section referred to the United States of America, Department of Energy, Washington, D.C. should be deleted. This is an error of Patentee and should be under Rule 323.

Col. 2, line 56: "130°C"should read --350°C.--

Signed and Sealed this

*Thirty-first* Day of *July 1979*

[SEAL]

*Attest:*

LUTRELLE F. PARKER

*Attesting Officer* *Acting Commissioner of Patents and Trademarks*